US007628223B2

(12) United States Patent
Andersson et al.

(10) Patent No.: US 7,628,223 B2
(45) Date of Patent: Dec. 8, 2009

(54) ROCK DRILLING DEVICE

(75) Inventors: Kurt Andersson, Tyresö (SE); Jörgen Rodert, Saltsjö-Boo (SE)

(73) Assignee: Atlas Copco Rock Drills AB, Orebro (SE)

( * ) Notice: Subject to any disclaimer, the term of this patent is extended or adjusted under 35 U.S.C. 154(b) by 48 days.

(21) Appl. No.: 11/663,085

(22) PCT Filed: Sep. 28, 2005

(86) PCT No.: PCT/SE2005/001424

§ 371 (c)(1),
(2), (4) Date: Mar. 15, 2007

(87) PCT Pub. No.: WO2006/038854

PCT Pub. Date: Apr. 13, 2006

(65) Prior Publication Data

US 2008/0115953 A1 May 22, 2008

(30) Foreign Application Priority Data

Oct. 7, 2004 (SE) ..... 0402421

(51) Int. Cl.
*B25D 17/26* (2006.01)

(52) U.S. Cl. ..... 173/197; 173/58; 173/73; 173/59; 173/66

(58) Field of Classification Search ..... 173/197, 173/58, 73; 384/31, 286–291, 397–399
See application file for complete search history.

(56) References Cited

U.S. PATENT DOCUMENTS 1,971,772 A * 8/1934 Curtis ..... 173/79
3,599,756 A * 8/1971 Pickle ..... 181/230
3,663,072 A * 5/1972 Cvacho ..... 384/13
3,804,474 A * 4/1974 Ettles ..... 384/399
3,838,953 A * 10/1974 Peterson ..... 418/186
3,863,737 A * 2/1975 Kakihara ..... 384/316
3,976,077 A * 8/1976 Kerfoot, Jr. ..... 606/107
3,993,370 A * 11/1976 Woollenweber ..... 384/287
4,068,727 A 1/1978 Andersson et al.
4,157,121 A 6/1979 Amtsberg et al.
4,204,718 A * 5/1980 Bosco ..... 384/286
4,280,570 A * 7/1981 Walter ..... 175/92
4,487,271 A * 12/1984 Pomeroy et al. ..... 173/29
4,583,601 A 4/1986 Techy
4,813,494 A * 3/1989 Beard et al. ..... 173/91
5,040,618 A 8/1991 Morrison et al.
5,951,172 A * 9/1999 Byrne ..... 384/313
6,179,470 B1 * 1/2001 Huddleston et al. ..... 384/279
6,315,063 B1 * 11/2001 Martini ..... 175/57
6,905,316 B2 * 6/2005 Parker et al. ..... 417/407

FOREIGN PATENT DOCUMENTS

WO 01/86107 11/2001

* cited by examiner

*Primary Examiner*—Brian D Nash
(74) *Attorney, Agent, or Firm*—Mark P. Stone

(57) ABSTRACT

A rock drilling machine includes a sleeve having openings surrounding a portion of a lubrication channel. A groove surrounds the sleeve, and one end of a second channel is connected to the groove. The other end of the second channel is connected to a lubrication point so that lubricant from the lubrication channel is distributed from the lubrication channel, through the sleeve and groove to the second channel, and from the second channel to a lubrication point of the rock drilling machine.

2 Claims, 1 Drawing Sheet

ROCK DRILLING DEVICE

BACKGROUND OF THE INVENTION

The present invention relates to a rock drilling device provided with a rock drilling machine which is movable forwards and backwards along a feed beam, wherein the rock drilling machine is pivotal around an axis which is arranged along the rock drilling machine. In particular the invention concerns such a device which is arranged to ensure good lubrication of vital parts independent of the pivoting of the rock drilling machine around the longitudinal axis.

According to previously known art, it is common to provide points of lubrication with lubricant by leading oil-rich air through a channel to the point of lubrication. This method has that drawback that the lubrication will be dependent on the pivot angle of the rock drilling machine with respect to its longitudinal axis, because the lubricant tends to accumulate at the bottom of the channel instead of appearing as an oil mist.

SUMMARY OF THE INVENTION

The present invention, as defined in the following patent claim, aims at providing a rock drilling device where the lubrication is essentially enhanced independent of the pivotal position of the rock drilling machine.

BRIEF DESCRIPTION OF THE DRAWING

An embodiment of the invention is described below with reference to the annexed drawing, wherein.

DESCRIPTION OF THE BEST MODE FOR CARRYING OUT THE INVETION

Figure 1:
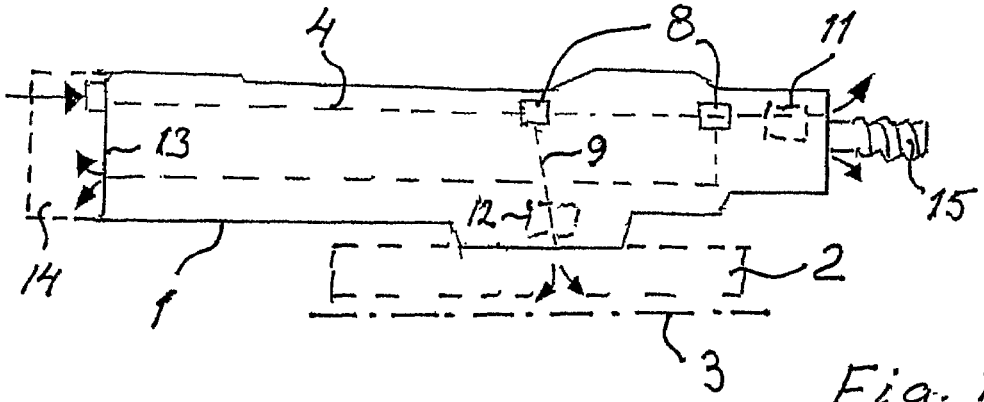
FIG. 1 shows a diagrammatical view of the rock drilling device.
Figure 2:
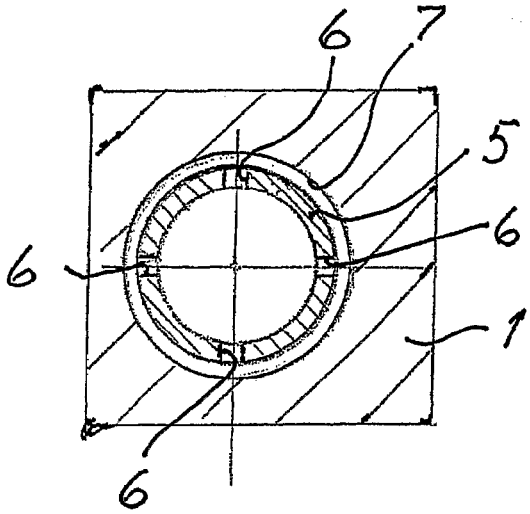
FIG. 2 shows a section through a part of the device according to FIG. 1.
Figure 3:
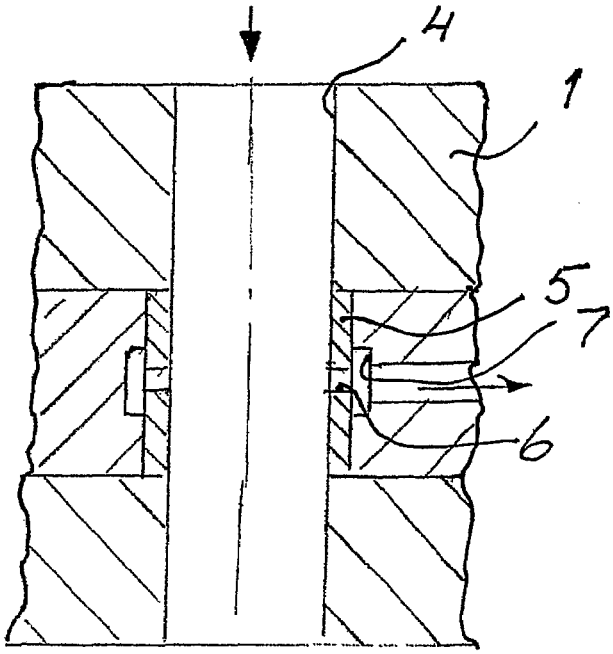
FIG. 3 shows a section through the part according to FIG. 2.

The rock drilling device shown on the drawing includes a rock drilling machine 1, which is movable forwards and backwards along a feed beam 2. The rock drilling machine 1 and the feed beam 2 are pivotal around an axis 3 which extends along the feed beam 2. A channel 4 is leading through the rock drilling machine 2 for supply of lubricant to different points of lubrication. This is achieved by means of oil-rich air. In the channel 4 there are a number of distributors 8 for distributing the lubrication air between the channel 4 and a further channel 9 which leads to the point of lubrication. In the shown example lubrication takes place of a front guide 11, a follower device 12 for rotation of a drilling tool 15 and a parting plane 13 between the main body of the rock drilling machine 1 and a rear portion 14. The construction of the distributors 8 is shown in more detail in FIGS. 2 and 3.

The distributor 8 includes a sleeve 5 which is positioned inside the channel 4, said sleeve being provided with a number of generally radial holes 6, distributed along the circumference of the sleeve 5. Around the sleeve 5 is arranged a groove 7 which connects the radial holes 6. The holes 6 are dimensioned in such a way that a suitable portion of the lubricant leaves the channel 4 through the radial holes 6 to the channel 9 and a point of lubrication connected thereto.

The invention claimed is:

1. Rock drilling machine adapted to be mounted to a feed beam of a rock drilling device, said rock drilling device having means for pivoting said rock drilling machine when mounted thereto, said rock drilling machine comprising: a first channel for supplying lubricant to lubrication points of said rock drilling machine;

at least one lubricant distribution device in fluid communication with said first channel, said lubricant distribution device comprising a sleeve in fluid communication with lubricant in said first channel, said sleeve defining a plurality of generally radial openings along the circumference of said sleeve, each of said openings extending between the inside and the outside of said sleeve, and a groove surrounding said sleeve, said groove being connected to all of said openings at the outside of said sleeve so as to be in fluid communication with lubricant in said first channel through said openings in said sleeve, and;

a second channel having a first end connected to said groove and a second end connected to at least one lubrication point of said rock drilling machine for supplying lubricant thereto from said first channel, wherein lubrication of said at least one lubrication point of said rock drilling machine is independent of the pivotal position of the rock drilling machine.

2. Rock drilling device comprising a rock drilling machine according to claim 1 and a feed beam, said rock drilling machine being movable forwards and backwards along said feed beam, wherein said feed beam is pivotably mounted in said rock drilling device.

* * * * *